US009198469B2

(12) United States Patent
Clement et al.

(10) Patent No.: US 9,198,469 B2
(45) Date of Patent: Dec. 1, 2015

(54) SHORT PANT HAVING A SEAMLESS BODY

(71) Applicant: HAYABUSA FIGHTWEAR INC., Kingston (CA)

(72) Inventors: Ken Clement, Milton (CA); Craig Clement, Kingston (CA); John David Zikakis, Mount Albert (CA)

(73) Assignee: HAYABUSA FIGHTWEAR INC., Kingston, Ontario (CA)

( * ) Notice: Subject to any disclaimer, the term of this patent is extended or adjusted under 35 U.S.C. 154(b) by 0 days.

(21) Appl. No.: 13/787,021

(22) Filed: Mar. 6, 2013

(65) Prior Publication Data

US 2013/0239294 A1 Sep. 19, 2013

Related U.S. Application Data

(60) Provisional application No. 61/612,478, filed on Mar. 19, 2012.

(51) Int. Cl.

| | |
|---|---|
| ***A41D 1/08*** | (2006.01) |
| ***A41D 27/24*** | (2006.01) |
| *A41D 27/00* | (2006.01) |

(52) U.S. Cl.

CPC ..... *A41D 1/08* (2013.01); *A41D 27/245* (2013.01); *A41D 2300/32* (2013.01); *A41D 2300/33* (2013.01)

(58) Field of Classification Search

CPC ..... B29C 65/00; B29C 66/43; B29C 65/02; B29C 65/4835; B29C 66/729; B29C 65/5028; B29C 65/5042; B29C 66/1352; B29C 66/112; B29C 66/135; B29C 66/431; A41D 27/245; A41D 1/08; A41D 13/0015; A41D 13/0005; A41D 13/0525; A41D 13/0556; A41D 13/1254; A41D 17/02; A41D 1/06; A41D 1/084; A41D 1/086; A41D 2300/30; A41D 2300/50; A41D 27/00; A41D 31/0005; A41B 2400/38; A41B 9/007; D06H 5/00; A63B 2071/1233; A63B 2071/1241; A63B 2209/00; A63B 69/00; A63B 71/1225

See application file for complete search history.

(56) References Cited

U.S. PATENT DOCUMENTS

| | | | | | |
|---|---|---|---|---|---|
| 3,939,565 | A | * | 2/1976 | Bush | 33/17 R |
| 4,017,910 | A | * | 4/1977 | Bente | 2/232 |
| 4,096,016 | A | * | 6/1978 | Pohl | 156/274.6 |
| 4,293,957 | A | * | 10/1981 | Melarvie | 2/2.17 |
| 4,369,528 | A | * | 1/1983 | Vest et al. | 2/69 |
| 4,722,710 | A | * | 2/1988 | Hagen et al. | 441/103 |
| 4,791,685 | A | * | 12/1988 | Maibauer | 2/227 |

(Continued)

*Primary Examiner* — Bobby Muromoto, Jr.

(74) *Attorney, Agent, or Firm* — Moore & Van Allen PLLC

(57) ABSTRACT

A short pant has the following: a body having a plurality of fabric sections assembled together in a seamless manner having a front region, a back region, and opposing side regions forming a pelvic region, a pair of thigh regions, an inner surface, and an outer surface; and a closure system, operatively coupled to the body at the pelvic region at a top waist edge, for securing the short pant during wearing; and the pair of thigh regions each having a bottom edge and having a slit on each opposing side region substantially perpendicular to and extending from the bottom edge upward a distance toward the top waist edge. The short pant may be used for athletics, such as for combat sports training or competition. The short pant has a seamless body and side slits for minimal irritation, for providing a lightweight short pant, for minimal hook-and-loop in the closure while maintaining proper fit and allowing unrestricted movement.

4 Claims, 3 Drawing Sheets

(56) References Cited

U.S. PATENT DOCUMENTS

| | | | | |
|---|---|---|---|---|
| 4,894,867 | A * | 1/1990 | Ceravolo et al. | 2/238 |
| 4,993,077 | A * | 2/1991 | Robison | 2/82 |
| 5,033,125 | A * | 7/1991 | de la Villefromoy et al. | 2/237 |
| RE33,966 | E * | 6/1992 | Robison | 2/82 |
| 5,222,257 | A * | 6/1993 | Bachor | 2/51 |
| 5,572,737 | A * | 11/1996 | Valice | 2/465 |
| 5,717,999 | A * | 2/1998 | Lurry | 2/69 |
| 6,243,878 | B1 * | 6/2001 | Khemka et al. | 2/227 |
| 6,622,312 | B2 * | 9/2003 | Rabinowicz | 2/401 |
| 6,820,312 | B1 * | 11/2004 | Senn | 24/697.2 |
| 7,024,892 | B2 * | 4/2006 | Blakely | 66/177 |
| 7,849,522 | B2 * | 12/2010 | Roux | 2/227 |
| 7,854,022 | B2 * | 12/2010 | Warren et al. | 2/401 |
| 7,882,605 | B2 * | 2/2011 | Senn | 24/697.2 |
| 7,891,026 | B1 * | 2/2011 | Smith | 2/465 |
| 7,908,671 | B2 * | 3/2011 | Gaugler et al. | 2/69.5 |
| 7,934,267 | B2 * | 5/2011 | Nordstrom et al. | 2/69 |
| 7,997,102 | B2 * | 8/2011 | Obadalova | 66/177 |
| 8,028,351 | B2 * | 10/2011 | Stachler et al. | 2/457 |
| 8,117,674 | B2 * | 2/2012 | Warren et al. | 2/401 |
| 8,123,590 | B2 * | 2/2012 | MacKinnon | 450/96 |
| 8,127,701 | B2 * | 3/2012 | Harward | 112/475.17 |
| 8,146,172 | B2 * | 4/2012 | Geiwald | 2/123 |
| 8,146,176 | B2 * | 4/2012 | Rudolph | 2/227 |
| 8,176,570 | B2 * | 5/2012 | Bedard et al. | 2/59 |
| 8,214,927 | B1 * | 7/2012 | Jondahl et al. | 2/228 |
| 8,347,412 | B2 * | 1/2013 | Clement | 2/22 |
| 8,402,565 | B1 * | 3/2013 | Penner | 2/227 |
| 8,518,511 | B2 * | 8/2013 | Harward | 428/57 |
| 8,713,715 | B1 * | 5/2014 | Lewis | 2/227 |
| 2005/0022920 | A1 * | 2/2005 | Fowler | 156/88 |
| 2005/0091731 | A1 * | 5/2005 | Franke et al. | 2/400 |
| 2005/0112976 | A1 * | 5/2005 | McMurray et al. | 442/306 |
| 2007/0028362 | A1 * | 2/2007 | Cash, Jr. | 2/227 |
| 2007/0226869 | A1 * | 10/2007 | Maier | 2/69 |
| 2008/0189824 | A1 * | 8/2008 | Rock et al. | 2/69 |
| 2010/0170026 | A1 * | 7/2010 | Jeffords | 2/227 |
| 2010/0240280 | A1 * | 9/2010 | Michel | 450/39 |
| 2011/0067159 | A1 * | 3/2011 | Smith | 2/22 |
| 2012/0282425 | A1 * | 11/2012 | Gallagher | 428/61 |

* cited by examiner

SHORT PANT HAVING A SEAMLESS BODY

FIELD OF THE INVENTION

The present invention relates generally to a short pant. More specifically, the present invention relates to an athletic short pant for combat sports such as wrestling, grappling, and martial arts, in particular mixed martial arts.

BACKGROUND

Combat sports, particularly combat sports such as wrestling, grappling, and mixed martial arts involve high impact, vigorous, dynamic movements that benefit from unrestricted motion. Protective gear and clothing worn must balance function with comfort which are often mutually exclusive.

A short pant most commonly worn during training and competing in combat sports is typically a basic short pant with modifications specifically for the desired use. These modifications include lack of metal hardware for protection and side slits and incorporation of stretch panels for less restricted movement, particularly of the legs. As such, a typical athletic short pant may use an elastic waistband for fastening the short pant. Alternatively, the short pant may use a drawstring or Velcro®. The material used is also chosen for the desired use. As such, materials are often lightweight, strong, and may incorporate anti-bacterial technology.

Most features to protect the wearer and to provide the wearer with a short pant that allows full range motion result in a less comfortable short pant. Typically the sturdiest fabric and reinforced stitching produce a short pant that is heavy and bulky and therefore uncomfortable.

Another shortcoming of a short pant currently used in combat sports is that they are designed to promote comfort and protection of the individual wearing them without any benefits to the partner or opponent merely incidental. There is a need for a short pant that is comfortable and yet provides protection for both the wearer and the training partner or opponent.

SUMMARY OF THE INVENTION

A short pant, in accordance with the present invention, solves the problems associated with the use of the prior art short pant.

The present invention provides a short pant comprising: a body having a plurality of fabric sections assembled together in a seamless manner having a front region, a back region, and opposing side regions forming a pelvic region, a pair of thigh regions, an inner surface, and an outer surface; and a closure system, operatively coupled to the body at the pelvic region at a top waist edge, for securing the short pant during wearing; and the pair of thigh regions each having a bottom edge and having a slit on each opposing side region substantially perpendicular to and extending from the bottom edge upward a distance toward the top waist edge. The present invention may be used for athletics, such as for combat sports training or competition. The short pant comprising a seamless body and side slits for minimal irritation, for providing a lightweight short pant, for minimal hook-and-loop in the closure while maintaining proper fit and allowing unrestricted movement.

BRIEF DESCRIPTION OF THE DRAWINGS

Aspects will now be described, by way of example only, with reference to the attached Figures, wherein like numbers represent like features.

DETAILED DESCRIPTION OF THE ASPECTS

Figure 1C:
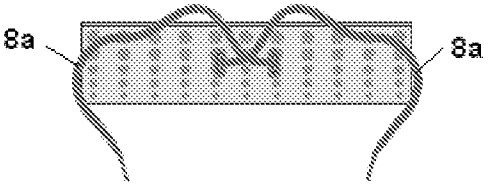
FIG. 1C shows the internal lace closure of the short pant shown in FIGS. 1A and 1B as view from the inside of the short pant.

For the purposes of the present invention, a short pant includes what is commonly known as shorts that have pant legs that end at or above the knee.

For the purpose of the present invention, the term seamless is defined as a substantially smooth surface seam or join. The term seamless includes seams or joins, such as welding, taping or circular knitting of seams i.e., seaming techniques that reduce irritation and render a substantially smooth surface.

The present invention seeks to provide a short pant with reduced irritation when used and yet unrestrictive to a wide variety of leg movements. In particular, the present invention seeks to provide a short pant with reduced irritation to both the wearer and the training partner, or opponent, while still offering greater unrestricted movement and comfort while maintaining proper fit, particularly during use. As such, the present invention provides a short pant with a seamless body.

Seamless fabric technology has primarily been used to produce smooth, conforming underwear, active-wear, swimwear, or compression-wear; or strong, leak-proof seams for outer-wear clothing and items such as tents, banners, inflatable boats, and various liners. Techniques to achieve seamless articles of clothing include circular knitting, seam taping, and joining of fabrics through welding such as sonic welding, hot air welding, radio frequency welding, ultrasonic welding, hot wedge welding, and acrylic welding or a combination of taping and welding.

It is herein understood the skilled artisan that although taping and welding actually leave seams where adjacent sections of fabric are joined, they are, for the purposes of the present invention described herein, functionally seamless because of the lack of stitches to facilitate joining of adjacent edges of fabric and are considered to be, and referred to as, seamless. The preferred technique to produce a seamless short pant of the present invention is seam taping, however any of the techniques known to the skilled artisan may be used to produce short pant in accordance with the present invention.

A short pant, including an athletic short pant, typically has a closure system. The closure system is a fastening means, to facilitate putting on of the short pant and ensuring that the short pant stays securely fixed on the wearer.

A short pant that lacks a fastening means generally has an elastic waistband to allow the short pant to be put on by expanding over the wearer's hip and securing over the wearer's waist. This flexibility in the material, however, is generally not suitable for activities such as combat sports, or other similar active sports or activities as the elastic waistband does not provide enough strength to hold the short pant in place during such activities.

Fasteners, such as fly-zippers, are also generally unsuitable as an athletic short pant, particularly for combat sports as the metal, or alternatively the plastic, pose an unnecessary risk of injury or breakage. The most common type of fastener used in an athletic short pant, particularly in combat sports, is hook-and-loop (Velcro®). In accordance with an aspect of the present invention, the preferred closure system is a hook-and-loop type. Various styles and configuration of hook-and-loop fasteners are known and suitable. For example, the closure may be configured in a vertical orientation, a horizontal orientation, or may have both with one acting to reinforce the other. In some aspects, the hook-and-loop closure system requires less hook-and-loop material in a short pant having a stitch-less body than in a short pant having a stitched body. In these aspects, the reduced amount of hook-and-loop contributes to an overall reduced weight of the short pant having a stitch-less body.

Another common type of closure system for an athletic short pant is the drawstring, or lace. A drawstring fastener is often used in conjunction with another type of fastener or an elastic waistband closure. In some aspects a drawstring is used in conjunction with hook-and-loop. For the short pant having a drawstring, any functional type of drawstring, as are known in the art, is suitable. The preferred type of drawstring is an internal flat lace tie—this particular system eliminates an outer face of the drawstring that may catch and become unfastened by external action such as friction or catching. In some aspects, the short pant has a hook-and-loop fastener with an internal flat lace tie. Although the body of the short pant in all aspects is assembled without stitching, the closure system may, in some aspects require stitching. In other aspects, the closure system requires less stitching than closure systems used with a pant having a stitched body.

The present invention provides that the length of the side slits on the short pant having a seamless body need to be shortened relative to a short pant having traditional stitched seams in order to facilitate proper fit, particularly during movement. In use in athletic activity, the longer side slits in conjunction with a stitch-less body often cause the fabric of the body of the short pant to bunch up and drape in an undesired manner not conducive to proper fit and function. While the side slits are still necessary to facilitate the needed freedom of movement, the side slits are shortened in accordance with an aspect of the present invention.

In the prior art, the shortened side slits on the short pant having a seamless body lack reinforcement in order to facilitate proper fit and function, particularly during standing, or activity performed when the wearer is upright. Any means of reinforcing the side slit is suitable and many techniques will be known by the skilled artisan. In accordance with an aspect of the present invention, the preferred method of reinforcing the side slit is with bar tack stitching on the edges, particularly along the bottom edge where there is no adjacent fabric panel.

In another aspect of the present invention, the bottom edge of the thigh regions of the short pant is scalloped. In conjunction with the seamless body and the shortened side slits, the scalloped edges further help to minimize any motion restriction and to reduce the weight of the short pant.

The most commonly known types of material (fabric) that are compatible with the particular method used to assemble the seamless body may be used for the short pant in accordance with the present invention. These fabrics include but are not limited to: polyester, polypropylene, cotton, nylon, silk, spandex, or various blends thereof. A given type of fabric may be manufactured or treated in such a way so as to impart a attribute or function such as but not limited to: lightweight, stretch fabric, mesh fabric, sweat absorbing, moisture wicking, fast drying, water repellent, smooth, antibacterial, and odor inhibiting. Furthermore, the fabrics used may be of any suitable weight, lightweight fabrics being particularly preferred.

Furthermore, the short pant of the present invention may be multilayered, provided that at least the outer layer, being the body, is seamless as herein described. In such aspects, the short pant may have a complete or partial inner layer. This inner layer may be of any particular type of material desired, particularly the types herein described. For example, the inner layer may be smooth satin for extra comfort or may be mesh to minimize added weight and improve breathability of the short pant.

According to present invention, the various panels that comprise the body may be of different fabrics to impart specific benefits. For example, certain panels may be of stretch material such as at the crotch region to provide extra mobility. As another example, certain panels of certain sections may be at least partial perforated, or contain a plurality of holes, e.g., mesh, to allow breathability of the fabric and to further reduce the weight of the short pant.

Specific aspects of the present invention will now be described with reference to the figures.

FIGS. 1, 2 and 3 each show a short pant 1, 2, and 3, respectively, having a seamless body 5 comprised of several fabric sections welded or taped together. The body 5 in each of FIGS. 1, 2 and 3 is assembled with different shapes and configurations of fabric sections 7. In FIG. 1, lines 10 represent seamless joining of adjacent fabric sections.

Figure 1B:
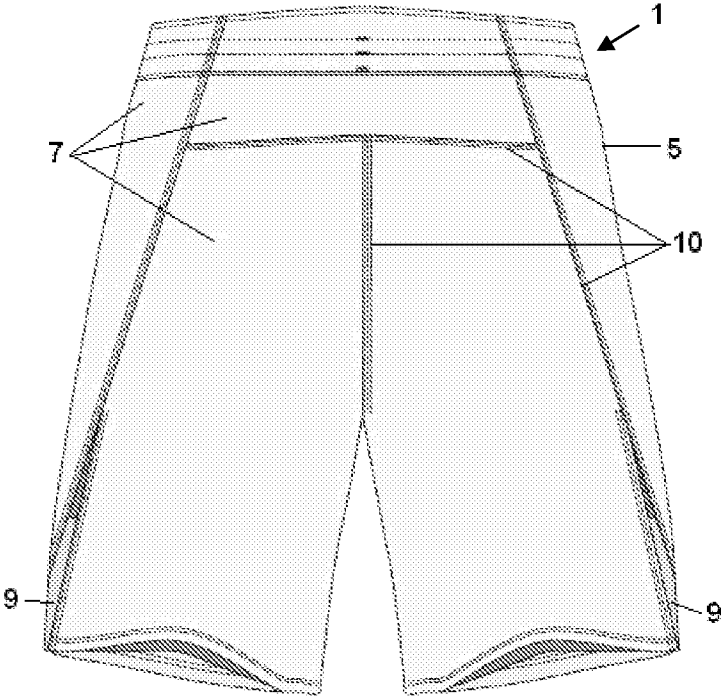
FIG. 1B shows a rear view of the short pant shown in FIG. 1A.
Figure 1A:
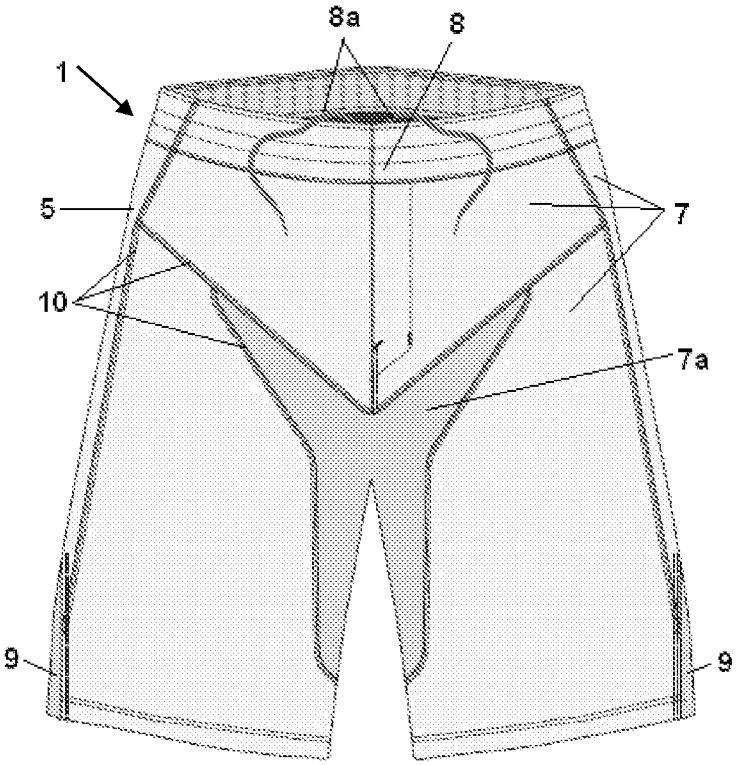
FIG. 1A shows a front view of a short pant of the present invention having a seamless body and side slits in accordance with an aspect thereof.

Referring now to FIGS. 1A and 1B, the front and rear views of the short pant 1 is shown respectively, in accordance with one aspect of the present invention. The body 5 is assembled from various fabric sections 7 (each left and right side of the short pant are essentially mirror images, so only the fabric panels in each case are identified). Also shown are side slits 9. In some aspects, fabric sections such as 7*a* may be made of a fabric distinct from the other fabric panels, for example a stretch fabric. The short pant 1 has a closure system 8 which may be of hook and loop type and may further have an internal lace or drawstring 8*a* in the inner surface. The internal lace 8*a* is shown in more detail in FIG. 1C as viewed from the inner surface of short pant 1. Alternatively, the closure system may be only the internal lace or drawstring 8*a*.

Figure 2B:
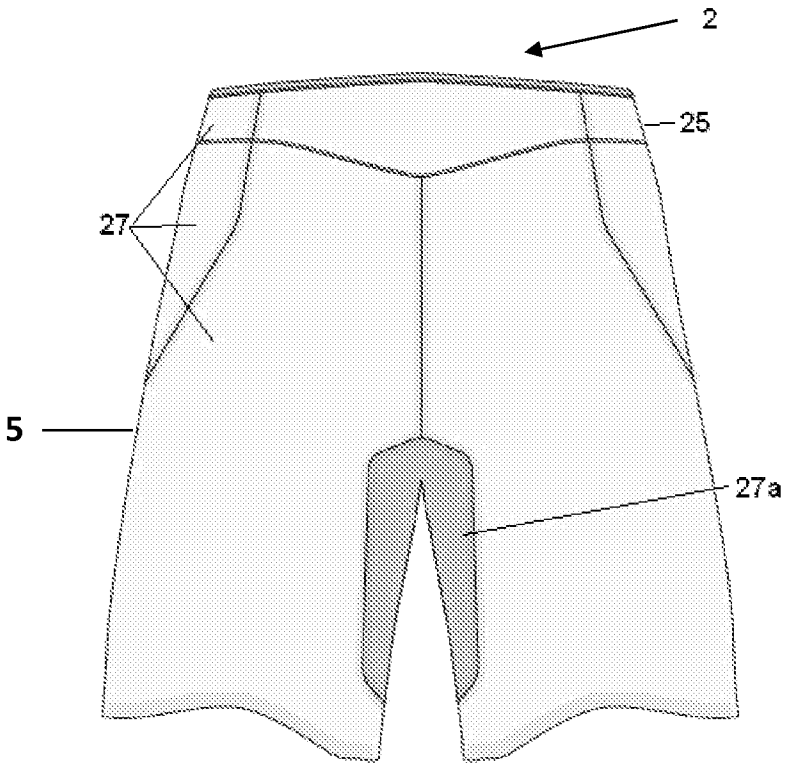
FIG. 2B shows a rear view of the short pant shown in FIG. 2A.
Figure 2A:
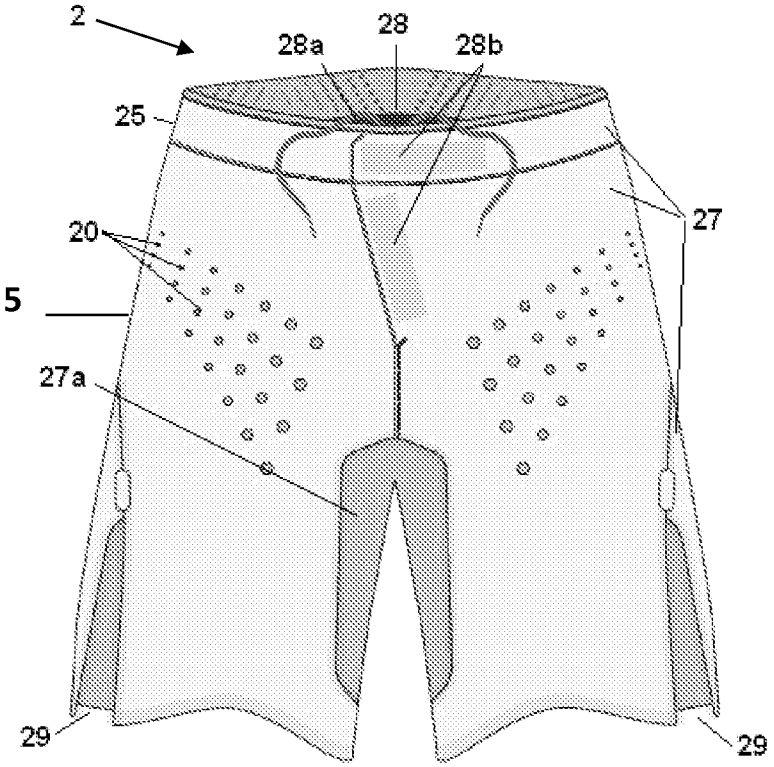
FIG. 2A shows a front view of the short pant of the present invention in accordance with another aspect thereof.

FIGS. 2A and 2B show the front and rear views, respectively, of a short pant 2 in accordance with another aspect of the present invention. Here, the body 25 is assembled from various fabric sections 27, which differ in shape and configuration compared to those of FIG. 1. Also shown are two side slits 29 (only visible in FIG. 2A).

As with the short pant shown in FIG. 1, specific fabric sections may be made of different fabrics. In some aspects, the fabric section 27*a* may be, for example, a stretch fabric. The closure system 28 of the short pant 2 is shown having an internal lace 28*a* and hook and loop sections 28*b*. In some aspects, some of the fabric sections may have holes 20 for increased ventilation; for example, fabric sections 27 of the front of short pant 2 (shown in FIG. 2A).

Figure 3B:
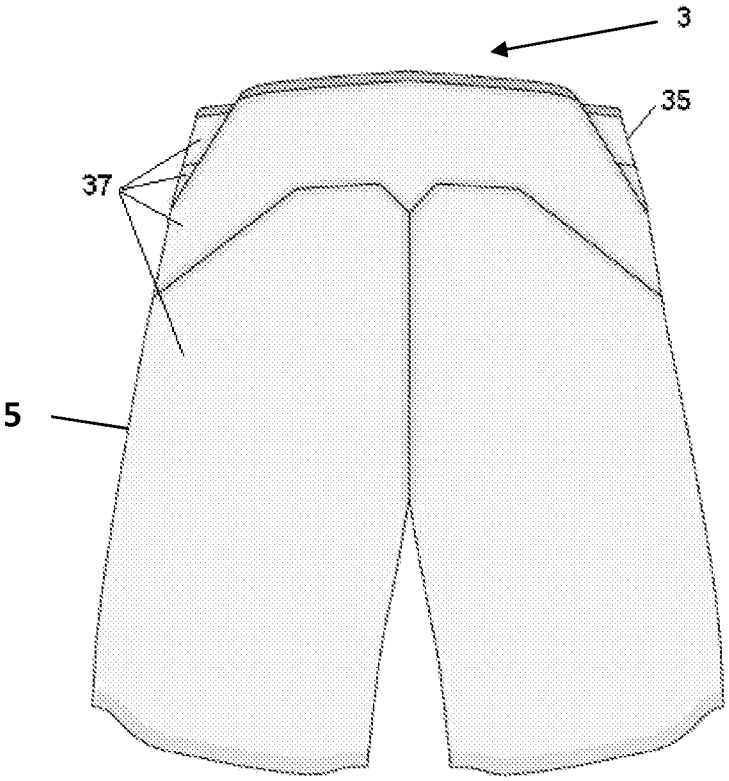
FIG. 3B shows a rear view of the short pant shown in FIG. 3A.
Figure 3A:
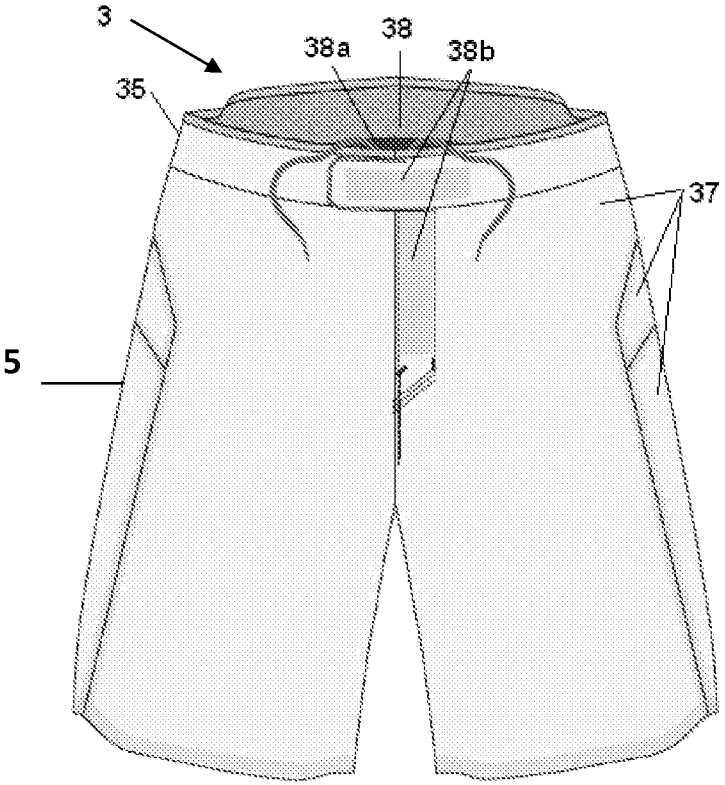
FIG. 3A shows a front view of the short pant of the present invention in accordance with a further aspect thereof.

FIGS. 3A and 3B show the front and rear views, respectively, of the short pant 3 according to another aspect of the present invention. The short pant 3 of fabric sections 37 forming a body 35 of a pair of short pant 3. Closure system 38 is shown having an internal lace 38*a* and hook and loop sections 38*b*. The short pant 3 is only intended to show another configuration of fabric sections and closure system and does not show side slits, which are understood to be present in the short pant in accordance with the present invention.

The short pant, as proposed by the present invention, solves the problems associated with the use of the prior art short pant and comprise a seamless body and shortened side slits.

In one aspect, the combination of the seamless body and the shortened side slits allows for short pant which result in less irritation for both the wearer and the training partner/opponent.

In another aspect, the combination of the seamless body and the shortened side slits allows for a short pant that requires less Velcro® as a fastener than a comparable short pant would require.

In another aspect, the combination of the seamless body and the shortened side slits reduces the weight of the short pant as compared to a short pant of the prior art.

In another aspect, the combination of the seamless body and the shortened side slits enables less restricted movement compared to a short pant of the prior art.

While the invention has been described with reference mainly to an athletic short pant for combat sports, other uses and types of activities will occur to those of skill in the art. For example, activities such as gymnastics, dancing, or yoga may also benefit from the use of a short pant described herein.

The above-described aspects are intended to be examples of the present invention and alterations and modifications may be effected thereto, by those of skill in the art, without departing from the scope of the invention which is defined solely by the claims appended hereto, consistent with the description.

What is claimed is:

1. A short pant for athletics comprising:

a body having a plurality of fabric sections assembled together in a manner having joins or seams with a substantially smooth surface, and the body having a front region, a back region, and opposing side regions forming a pelvic region, a pair of thigh regions, an inner surface, and an outer surface;

a closure system, operatively coupled to the body at the pelvic region at a top waist edge, for securing the short pant during wearing;

the pair of thigh regions each having a bottom edge and having a first slit and a second slit located on each opposing side region distal from the pelvic region and substantially perpendicular to and extending from the bottom edge upward a distance toward the top waist edge;

a first fabric section that is assembled within the first slit;

a second fabric section that is assembled within the second slit;

wherein the bottom edge corresponding to each of the pair of thigh regions defines a perimeter and each of the first and second slits extends along only a portion of the perimeter;

wherein the closure system comprises an internal flat lace tie;

wherein the first slit and the second slit are reinforced with bar tack stitching on each edge of the slit; and wherein at least one of the plurality of fabric sections is partially perforated to enable breathability of the at least one fabric section.

2. The short pant of claim 1, wherein the manner for assembling the plurality of fabric sections is selected from the group consisting of seam taping, welding, and circular knitting.

3. The short pant of claim 1, wherein the first slit and the second slit are constructed and arranged to enable unrestricted movement of the user and prevent substantial bunching of the short pant when used in athletic activity.

4. The short pant of claim 1, wherein the partially perforated fabric section is a plurality of holes.

* * * * *